US011391091B2

(12) United States Patent
Vazquez et al.

(10) Patent No.: US 11,391,091 B2
(45) Date of Patent: Jul. 19, 2022

(54) MODULAR REAMING DEVICE

(71) Applicant: HALLIBURTON ENERGY SERVICES INC., Houston, TX (US)

(72) Inventors: Saul Emmanuel Vazquez, Humble, TX (US); Carlos Alejandro Valdez, Humble, TX (US); Todd Anthony Stair, Spring, TX (US); Mark Lance Haire, Humble, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/191,216

(22) PCT Filed: Aug. 17, 2016

(86) PCT No.: PCT/US2016/047255

§ 371 (c)(1),
(2) Date: Nov. 14, 2018

(87) PCT Pub. No.: WO2018/034657

PCT Pub. Date: Feb. 22, 2018

(65) Prior Publication Data

US 2019/0169937 A1 Jun. 6, 2019

(51) Int. Cl.

| | |
|---|---|
| ***E21B 10/26*** | (2006.01) |
| ***E21B 17/10*** | (2006.01) |
| ***E21B 1/26*** | (2006.01) |

(52) U.S. Cl.
CPC ..... *E21B 1/26* (2020.05); *E21B 17/1085* (2013.01)

(58) Field of Classification Search
CPC ..... E21B 10/26; E21B 17/1085
See application file for complete search history.

(56) References Cited

U.S. PATENT DOCUMENTS

| | | | | |
|---|---|---|---|---|
| 3,603,412 | A * | 9/1971 | Kammerer, Jr | E21B 7/208 175/260 |
| 4,275,935 | A | 6/1981 | Thompson et al. | |
| 4,330,043 | A | 5/1982 | Sheffield et al. | |
| 4,385,669 | A | 5/1983 | Knutsen | |
| 6,983,811 | B2 | 1/2006 | Wardley | |
| 8,025,107 | B2 | 9/2011 | Drivdahl et al. | |
| 9,145,746 | B1 * | 9/2015 | Smith | E21B 17/1078 |
| 9,470,048 | B1 * | 10/2016 | Smith | E21B 7/28 |

(Continued)

OTHER PUBLICATIONS

International Search Report and Written Opinion; PCT Application No. PCT/US2016/047255; dated May 12, 2017.

(Continued)

*Primary Examiner* — Dany E Akakpo
(74) *Attorney, Agent, or Firm* — Novak Druce Carroll LLP

(57) ABSTRACT

A modular reaming device incorporable into a tubular string. The modular reamer can include a tubular body having a first end and a second end and an internal bore, the internal bore extending longitudinally through the tubular body from the first end to the second end. The tubular body has an external surface with an outer diameter with cutting elements extending from the tubular body beyond the outer diameter of the tubular body for engagement with a bore hole sidewall. Each of the first and second ends have a coupling for coupling engagement with a tubular string.

6 Claims, 5 Drawing Sheets

(56) References Cited

U.S. PATENT DOCUMENTS

| | | | | |
|---|---|---|---|---|
| 2006/0028321 | A1* | 2/2006 | Kennedy | E21B 47/0905 340/385.1 |
| 2007/0289782 | A1 | 12/2007 | Clark et al. | |
| 2011/0284291 | A1 | 12/2011 | Nichols et al. | |
| 2012/0160562 | A1* | 6/2012 | Ugwuocha | E21B 10/42 175/57 |
| 2014/0202770 | A1 | 7/2014 | Zaki et al. | |
| 2015/0299514 | A1 | 10/2015 | Chiu et al. | |
| 2015/0308195 | A1 | 10/2015 | Mitchell | |
| 2016/0208562 | A1* | 7/2016 | Millet | C10M 103/06 |

OTHER PUBLICATIONS

Great Britain Examination Report, Application No. GB1819010.8, dated Jan. 11, 2021.

* cited by examiner

MODULAR REAMING DEVICE

CROSS-REFERENCE TO RELATED APPLICATIONS

This application is a national stage entry of PCT/US2016/047255 filed Aug. 17, 2016, said application is expressly incorporated herein in its entirety.

FIELD

The present disclosure relates generally to reaming tools. In particular, the subject matter herein generally relates to reaming tools for tubular strings and insertion of the same into subterranean wellbores.

BACKGROUND

Subsequent to drilling a borehole into subterranean zones in the earth, a casing, production tubing, and/or other tubulars are inserted therein during various phases of hydrocarbon recovery. The casing is often cemented within the borehole to prevent contamination and also to provide greater control over processes in the wellbore. Additional production tubing can be provided within the casing or in uncased portions of the wellbore for withdrawing hydrocarbons or providing various fluids.

Despite the intention of drilling a clean cylindrical borehole, oftentimes the surfaces of the borehole are jagged or have doglegs along its path. Accordingly, when inserting casing or other tubulars, sometimes a reaming shoe is placed on an end thereof. The reaming shoe can have abrasive material on its outer surface to assist in removing or reducing any obstructions which may otherwise have impeded the progress of the casing or other tubular. Reaming tools can also assist in smoothing out or widening the borehole.

BRIEF DESCRIPTION OF THE DRAWINGS

Implementations of the present technology will now be described, by way of example only, with reference to the attached figures, wherein.

DETAILED DESCRIPTION

Figure 1:
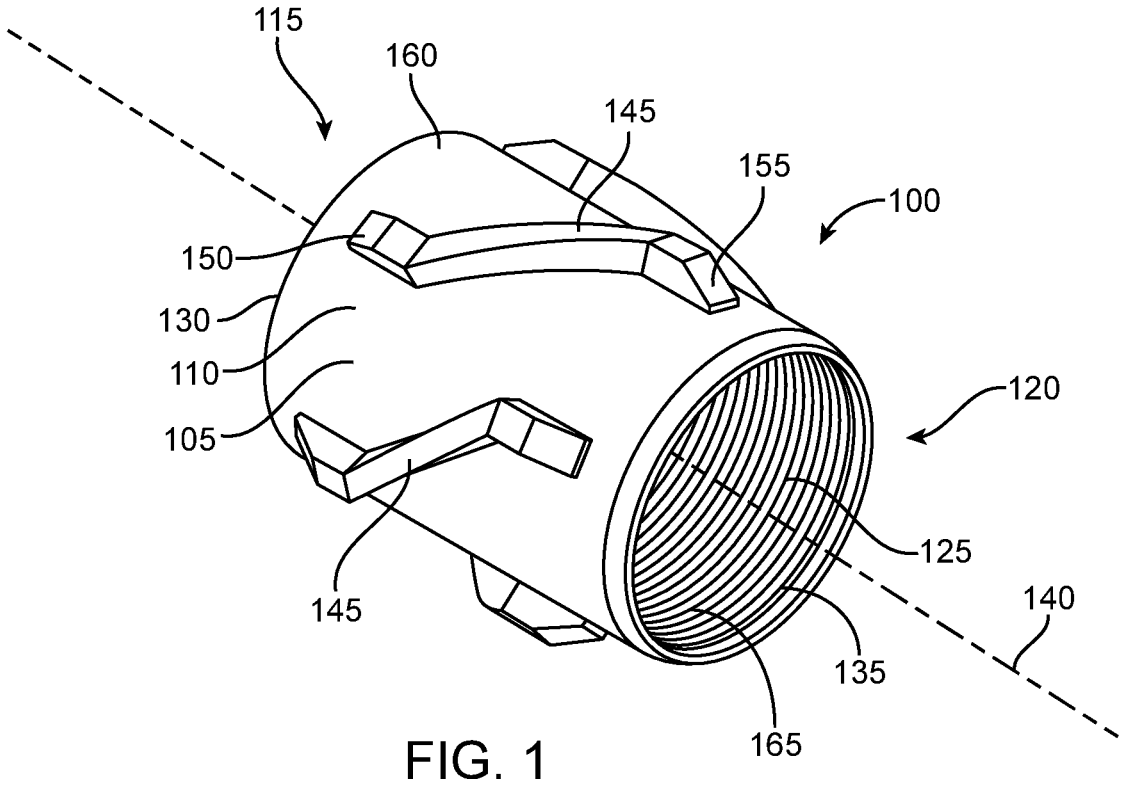
FIG. 1 is a diagram illustrating an exemplary modular reamer as disclosed herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected.

The present disclosure is directed to a modular reamer which is incorporable into a pipe string as a coupler (e.g., collar) or as an end shoe. The modular reamer may be a tubular body having cutting elements on its external surface. The modular reamer may have a coupling on both of its ends so that it may couple directly with a casing or pipe. In particular, by these couplings it may be easily incorporated into any tubular string, such as a casing string or production tubing string as they are assembled. The modular reamer may join any two tubulars together thereby serving as a coupling device. Additionally, it may be added to the end of a tubular string to act as a reamer shoe.

The modular reamer disclosed herein provides a flexible and versatile device which can be adapted for incorporation into various tubular strings and in multiple places along the length as desired to remove wellbore obstructions. Furthermore, standard equipment may be modified to prepare the device. For instance, a standard joint collar can be converted to the modular reamer device disclosed herein. Cutting elements can be cladded, brazed, deposited, or otherwise bonded onto the external surface of the collar, which can then be used to join two pipes, such as casing or production tubing. Alternatively, blank tubular bodies can be provided and converted on site to be adapted as needed. As a modular reamer is required, cutting elements can be cladded or blazed onto the external surface, and one or both ends of the tubular body modified to be a coupling, such as a desired threading. The converted modular reamer can then be incorporated or coupled as needed with various tubulars.

The following provides a more detailed discussion of the components herein.

FIG. 1 illustrates an exemplary modular reamer 100. The modular reamer 100 has a tubular body 105 with an inner bore 125 extending therethrough from a first end 115 to a second end 120. The tubular body 105 has a first opening 130 at the first end 115 and a second opening 135 at the second end 120, the inner bore 125 extending longitudinally between the first opening 130 and second opening 135. A central axis 140 is shown extending longitudinally along the length of the tubular body 105.

The tubular body 105 has an external surface 110 and an outer diameter. The outer diameter may vary depending on the size of the borehole as well as the diameter and size of the particular casing, tubing or other tubulars that are employed. A plurality of cutting elements 145 are provided extending from the external surface 110 of the tubular body 105. The plurality of cutting elements 145 extend beyond the outer diameter of the tubular body 105. Accordingly, the tubular body, alone or coupled with tubing, may engage with the surface of the borehole via cutting elements 145 to grind and cut the surface of the wellbore or degrade or break obstructions. The cutting elements 145 are made up of a hard or abrasive material or any hard durable wear-resistant materials such as tungsten carbide, polycrystalline diamond compact (PDC), particle-matrix composite material, or a combination or mixture thereof. Alternatively, the cutting elements 145 may be made up of the same material as the tubular body 105, or may be metal, alloys of iron, steel, metal alloy, or composite of metal and non-metals. Exemplary steels include carbon steel, such as A34, SAE 1018, SAE 1020, and the like.

Figure 2:
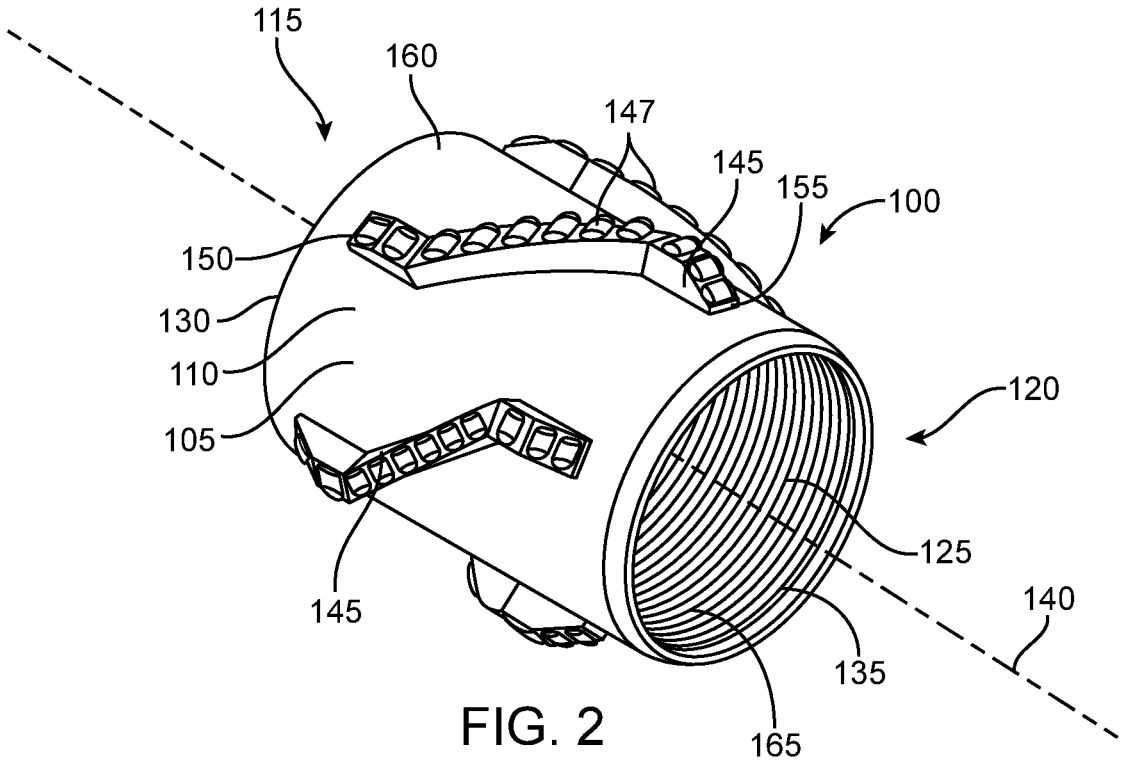
FIG. 2 is a diagram illustrating an exemplary modular reamer as disclosed herein.
Figure 3:
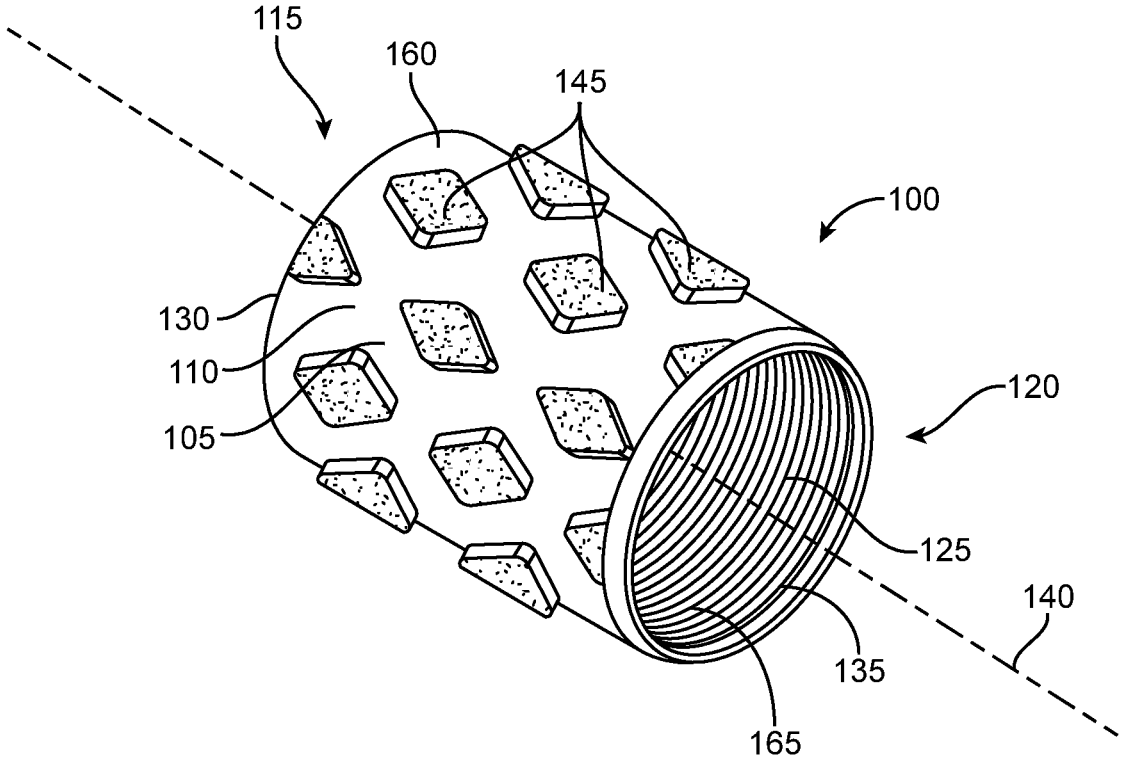
FIG. 3 is a diagram illustrating an exemplary modular reamer as disclosed herein.

The cutting elements 145 as shown in FIG. 1 are in the form of blades. The blades may extend along a length of the tubular body in the longitudinal direction of the tubular body. As also shown in FIG. 1, the blades may also extend diagonally with respect to the central axis 140. The blades may be provided in any variety of shapes such as helical, curved, or zig zag. The cutting elements 145, such as blades, may be provided circumferentially 360° around the tubular body 105. Meaning that a portion of a cutting element 145 will be encountered at each point around the circumference of the tubular body at some point along its length longitudinally from the first end 115 to the second end 120. Accordingly, the plurality cutting elements 145, may be provided such that each element, or blade, are aligned (helically) and may overlap one another longitudinally such that a leading end of one cutting element overlaps longitudinally the trailing end of an adjacent blade. Further, partial coverage can be provided, such as less 360° or less, such as 270° or less, 180° or less, 90° or less, or at a range of from 270° to 360° coverage, or 180° to 360° coverage, or 90° to 360° coverage. As shown in FIG. 2, the cutting elements 145 may have cutters 150 thereon which may be polycrystalline diamond compact (PDC) or other hard cutting material. As shown in FIG. 3, the cutting elements may be provided in a patched pattern, and may have a diamond shape. The cutting elements may have other shapes such as round, square, or any other polygonal shape, and may be provided as random or ordered patterns. As shown, each end of the blades in FIG. 1 have a tapered end. The cutting elements 145 may have a first tapered end 150 and have a second tapered end 155.

The tubular body 105 can be made of any hard, rigid material. The tubular body 105 may be made up of a metal, such as steel or other alloy, or other hard material able to withstand downhole conditions. The steel may be grade P110 or greater according to API 5CT. The tubular body 105 may be the same material as the downhole casing, pipe or other tubular to which it will be coupled, which may also be grade P110 or greater according to API 5CT.

The cutting elements 145 may be cladded or brazed, including laser cladding, or deposited, such as via laser metal deposition, direct metal depositions, additive manufacturing, or otherwise bonded or attached to the external surface 110. By this method, standard equipment can be converted on site or beforehand to the modular reamer disclosed herein. For example a standard joint collar can be converted to a modular reamer by cladding or brazing cutting elements thereon. This permits those in the field to adapt a tubular string to include a reamer as needed. Alternatively, the cutting elements can be formed as part of the tubular body 105 during production or molding.

Each of the first and second ends 115, 120 have a coupling for coupling engagement with a tubular string. Such coupling may be any type sufficient to fix the modular reamer to a casing, pipe or other tubular. Tubulars can be coupled to both of the first and second ends 115, 120 thereby acting as a collar or coupling to form a tubular string. Coupling can include threaded engagement (threaded ends of tubulars engaging with the threaded ends of the modular reamer), or via welding, or by other coupling. The coupling on the modular reamer may be a male or female threaded end. For instance, as shown in FIG. 1, both the first and second ends 115, 120 may have first female threaded end 160 and second female threaded end 165. Alternatively, both first and second ends 115, 120 may be male threaded ends. Alternatively, the first end 115 may be a male threaded and the second end 120 may be a female threaded end, or vice versa. In the context of casing or production piping, the reamer 100 may have two female threaded ends.

The modular reamer 100 may be employed to couple two tubulars together. Tubulars are defined herein to include, but not limited to, casings, tubing, production tubing, jointed tubing, coiled tubing, liners, as well as drill pipe, combinations thereof, or the like. Individual tubulars are sometimes referred to as joints, which may be a length of casing, pipe or other tubular. The length of tubulars may vary depending on the type of tubular or process being carried out. An exemplary casing joint may be for example about 40 feet in length, and a drill pipe may be about 30 feet in length. A length for an individual tubular or joint may be from about 20 to 50 feet, or alternatively from about 30 to 40 feet in length.

Figure 4:
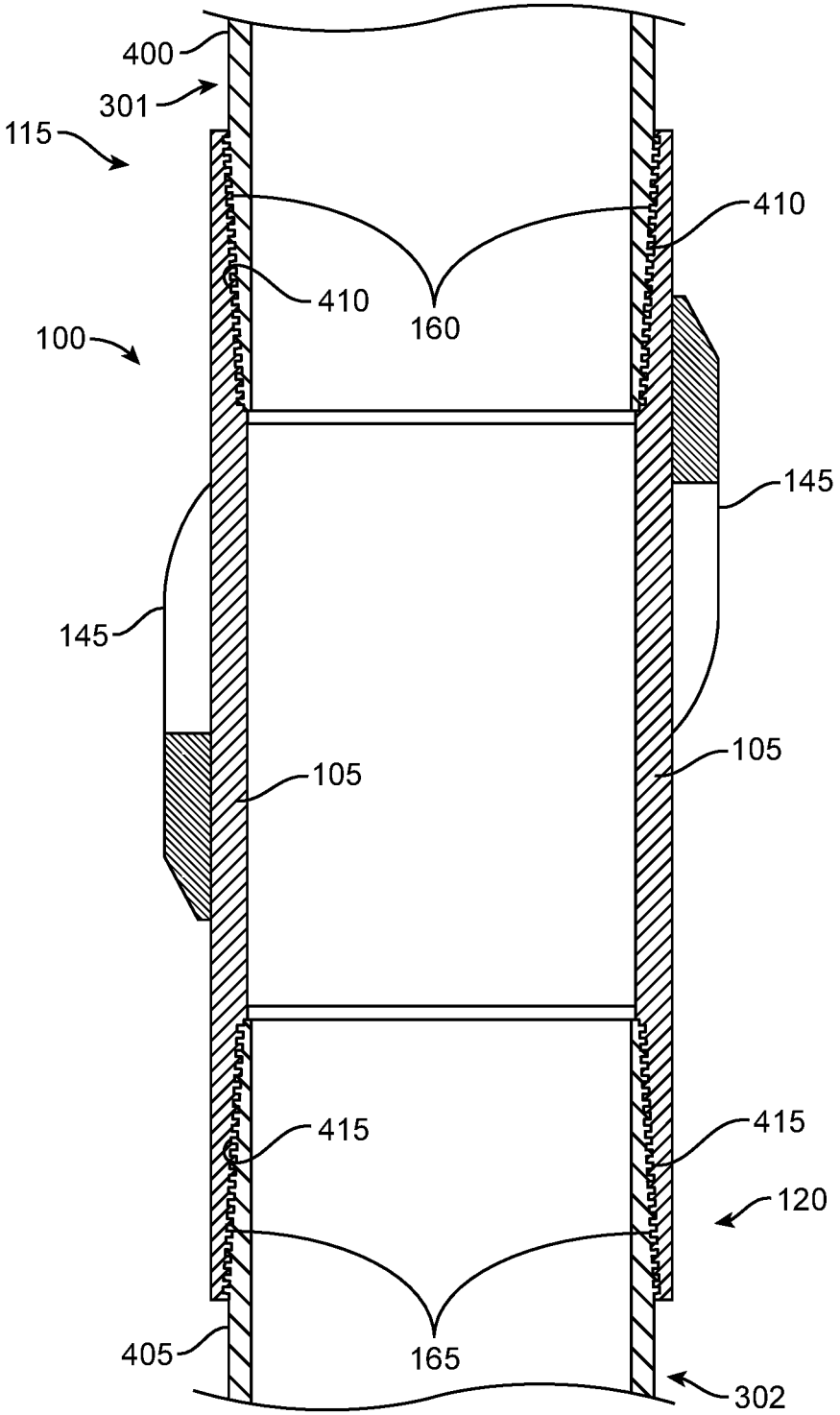
FIG. 4 is a is a diagram illustrating an exemplary modular reamer coupled with casing tubulars as disclosed herein.

As illustrated in FIG. 4, the modular reamer 100 is coupling together a first casing 400 and a second casing 405. In particular, the first casing 400 is coupled to the first end 115 of the tubular body 105, and the second casing 405 is coupled to the second end 120 of the tubular body 105. The tubular body 105 has a female threaded end on each side. Accordingly, the thread is on the external surface of each of the first and second ends 105, 120 to form the first female threaded end 160 and second female threaded end 165. Each of the first and second female threaded ends 160, 165 may also taper inwardly. The first and second threaded ends 160, 165 engage the first male threaded end 410 of casing 400 and the second male threaded end 415 of casing 415. The coupling accordingly forms a tubular string. The first and second casings 400, 410 may be coupled to other casings (to form a longer tubular string), tools or reamer devices. Although a casing is employed as illustration in FIG. 3, any tubulars may be employed as disclosed herein.

Figure 5:
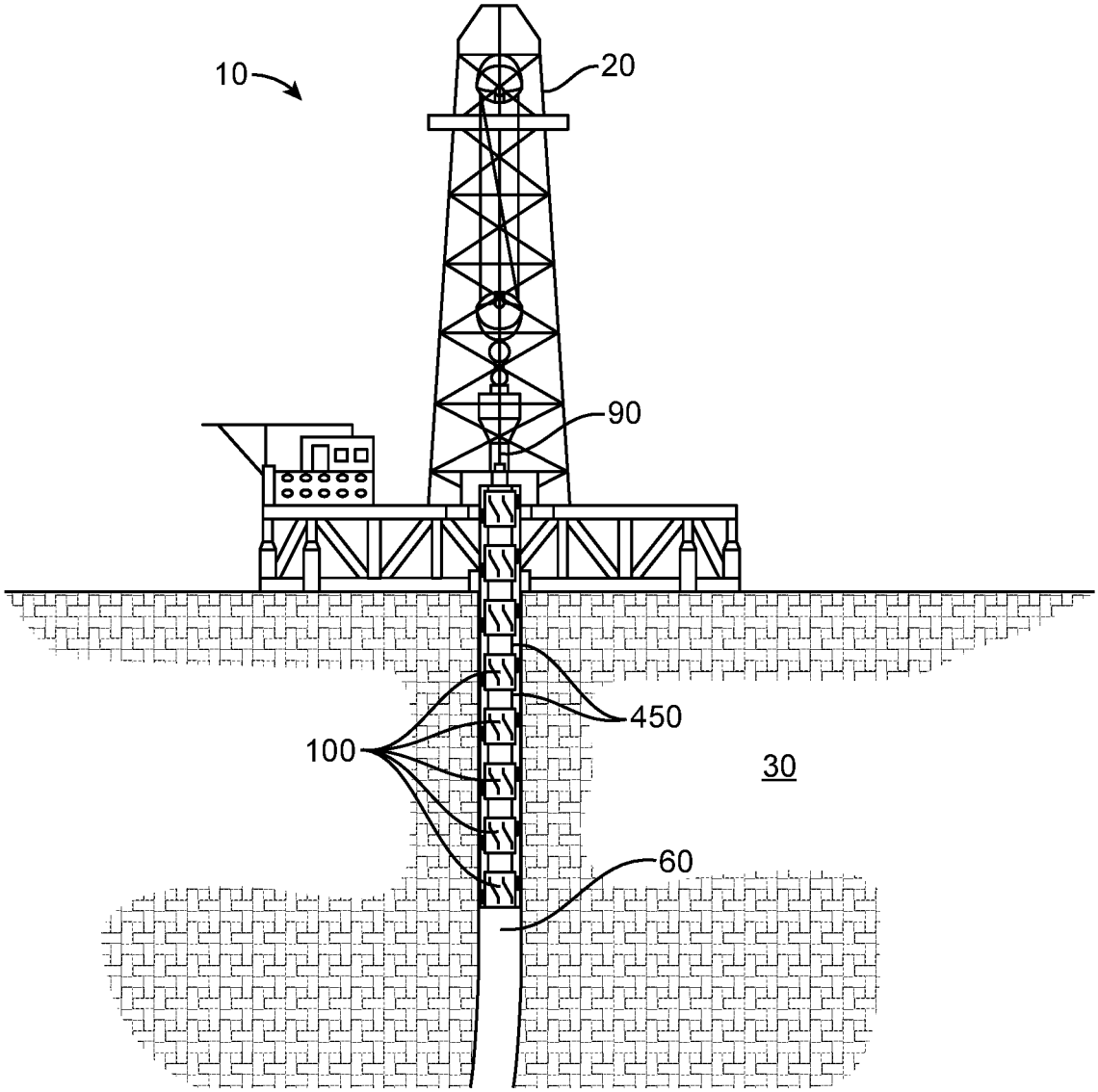
FIG. 5 is a diagram illustrating an environment for the use of an exemplary modular reamer disclosed herein.
Figure 6:
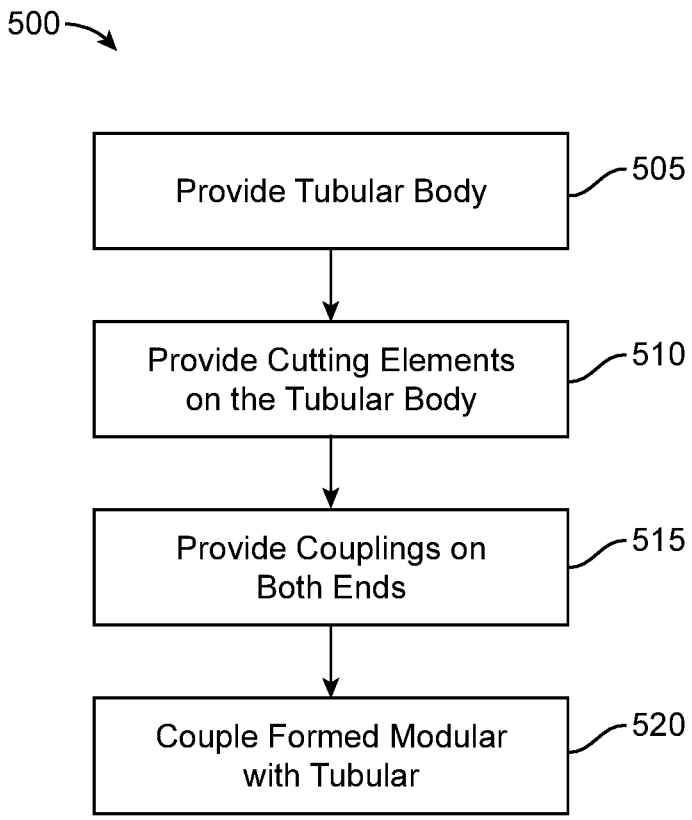
FIG. 6 illustrates a flow diagram for making and using the modular reamer disclosed herein.

Illustrated in FIG. 5 is an exemplary environment 10 for employment of the modular reamer 100. As shown in FIG. 5, there is a rig 20 having a borehole 60 which has been drilled into the earth 30. The modular reamer 100 has coupled together casing tubulars 450. The coupled components are together inserted into the borehole for placement. The modular reamer 100, coupled with the first and second casing 400, 405, acts to ream, cut, or otherwise assist entry through jagged or non-smooth portions of the borehole. Further, the modular reamer can be placed at the end of the very first casing or piping so as to serve as a reaming shoe. Moreover, the modular reamer can be coupled between a plurality of casings (or other tubulars), and so can be placed at numerous places in the string. Although a casing is employed in FIG. 5, the same can be employed with any tubular. For example, the modular reamer 100 can be employed to couple drill pipe or production tubing.

A method as illustrated in flow diagram 500 of FIG. 5 can be implemented regarding the modular reamer as disclosed herein. As shown in 505, the process can begin with a blank tubular body. This permits those in the field to modify as needed depending on the type of tubulars employed and the requirements of the hydrocarbon production process. Alternatively, these steps can be conducted off-site and once the modular reamer is prepared, it can be sent to the oil site for use. As shown in 510, cutting elements may be formed on the tubular body. The cutting elements can be cladded on or brazed on the tubular body. In 515, couplings can be added to both ends of the tubular body. Alternatively, if the tubular body is a standard joint collar, then the tubular body may already have threaded ends for coupling with various tubulars. Such couplings can be male or female threaded ends for instance. As shown in 520, the modular reamer, once having couplings and cutting elements can be coupled with a tubular on one or both ends. Many tubulars can be coupled together to form a tubular string. Further a plurality of modular reamers can be coupled within the string, and/or on the end of the string as a shoe.

Numerous examples are provided herein to enhance understanding of the present disclosure. A specific set of statements are provided as follows.

Statement 1: A modular reaming device incorporable into a tubular string including a tubular body having a first end and a second end and an internal bore, the internal bore extending longitudinally through the tubular body from the first end to the second end, the tubular body having an external surface with an outer diameter; and cutting elements extending from the tubular body beyond the outer diameter of the tubular body for engagement with a bore hole sidewall, and wherein each of the first and second end have a coupling for coupling engagement with a tubular string.

Statement 2: The modular reaming device according to Statement 1, wherein the first and the second end are both threaded.

Statement 3: The modular reaming device according to Statement 1 or Statement 2, wherein the first and the second end are both female threaded, whereby the modular reaming device serves as a collar.

Statement 4: The modular reaming device according to Statements 1-3, wherein the first end is female threaded, and the second end is male threaded.

Statement 5: The modular reaming device according to Statements 1-4, wherein the tubular body is selected from the group consisting of metal, metal alloy, alloys of iron, steel, or mixtures thereof.

Statement 6: The modular reaming device according to Statement 5, wherein the tubular body is steel and is grade P110 or greater according to API 5CT.

Statement 7: The modular reaming device according to Statements 1-6, wherein the cutting elements are selected from the group consisting of metal, metal alloy, alloys of iron, steel, composite or mixtures thereof.

Statement 8: The modular reaming device according to Statements 1-7, wherein the cutting elements are cladded, deposited or brazed to the external surface of the tubular body.

Statement 9: The modular reaming device according to Statements 1-8, wherein the cutting elements are a plurality of blades disposed on the external surface of the tubular body extending along a longitudinal length of the tubular body.

Statement 10: The modular reaming device according to Statements 1-9, wherein the plurality of blades taper at each end.

Statement 11: The modular reaming device according to Statements 1-10, wherein the plurality of blades extend diagonally with respect to a longitudinal axis of the internal bore of the tubular body.

Statement 12: A method of making a modular reaming device including: forming cutting elements on an external surface of a tubular body, the external surface having an outer diameter and the cutting elements extending beyond the outer diameter, the tubular body having an internal bore extending longitudinally through the tubular body from a first end to the second end of the tubular body; and forming a coupling on at least one of the first or second end of the tubular body for coupling engagement with a tubular string.

Statement 13: The method according to Statement 12, wherein the coupling is a threaded end.

Statement 14: The method according to Statements 12 or 13, wherein both the first end and second end is threaded.

Statement 15: The method according to Statements 12-14, wherein both ends are female threaded ends.

Statement 16: The method according to Statements 12-15, further comprising coupling the modular reaming device to at least one of a casing or a drillpipe string.

Statement 17: The method according to Statements 12-16, further comprising coupling a first end to a first casing or first drillpipe and coupling the second end to a second casing or second drillpipe.

Statement 18: The method according to Statements 12-17, further comprising disposing the modular reaming device coupled to the first casing and second casing into a borehole.

Statement 19: The method according to Statements 12-18, wherein the tubular body is selected from the group consisting of metal, metal alloy, alloys of iron, steel, or mixtures thereof.

Statement 20: A modular reaming system including: a tubular body having a first end and a second end and an internal bore, the internal bore extending longitudinally through the tubular body from the first end to the second end, the tubular body having an external surface with an outer diameter; and cutting elements extending from the tubular body beyond the outer diameter of the tubular body for engagement with a bore hole sidewall, and wherein each of the first and second end have a coupling for coupling engagement with a tubular string.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed:

1. A method comprising:

forming cutting elements comprising tungsten carbide on a respective external surface of each one of a plurality of tubular bodies, the respective external surface having an outer diameter and the cutting elements extending beyond the outer diameter, each of the plurality of tubular bodies having an internal bore respectively extending longitudinally through each of the plurality of tubular bodies from a respective uphole end to a respective downhole end of each of the plurality of tubular bodies, wherein the respective uphole end and respective downhole end are both configured to couple to casings;

coupling, at a well site, the respective uphole end of at least one of the plurality of tubular bodies to a downhole end of at least one of the casings and the respective downhole end of the at least one of the plurality of tubular bodies to a casing shoe thereby coupling the casing shoe with the downhole end of the casing;

inserting the casing in a wellbore drilled in a previous drilling operation; and withdrawing hydrocarbon through the plurality of tubular bodies.

2. The method of claim 1, wherein the coupling is via a threaded end.

3. The method of claim 1, wherein both the uphole end and the downhole end are threaded.

4. The method claim 1, wherein the uphole end is female threaded, and the downhole end is male threaded.

5. The method of claim 1, wherein the tubular bodies are made of a material selected from the group consisting of steel, metal, metal alloy, or mixtures thereof.

6. A modular reaming system comprising:

at least one casing inserted in a previously drilled wellbore;

the least one casing shoe coupled with a downhole end of the casing;

a plurality of modular collars incorporable, at a well site, into the casing shoe, each of the plurality of modular collars having an uphole end and a downhole end and an internal bore, wherein at least one of the plurality of modular collars has the respective uphole end coupled to a downhole end of the least one casing and the respective downhole end to the casing shoe, each of the internal bores respectively extending longitudinally through each of the modular collars from the uphole end to the downhole end, each of the plurality of modular collars having an external surface with an outer diameter, wherein the respective uphole end of each of the plurality of modular collars are configured to couple to a first casing of the at least one casing and the respective downhole end of each of the plurality of modular collars are configured to couple to a second casing of the at least one casing; and cutting elements comprising tungsten carbide extending from each of the plurality of the modular collars beyond the outer diameter of the external surface for engagement with a bore hole sidewall.

* * * * *